US008128011B2

(12) United States Patent
Berger et al.

(10) Patent No.: US 8,128,011 B2
(45) Date of Patent: Mar. 6, 2012

(54) METHOD FOR COMMINUTING MATERIAL TO BE GROUND USING A ROLLER MILL

(75) Inventors: Markus Berger, Ennigerloh (DE); Ludwig Könning, Ahlen (DE); Marco Völlink, Muenster (DE); Franz-Josef Zurhove, Bad Iburg (DE)

(73) Assignee: Polysius AG, Beckum (DE)

( * ) Notice: Subject to any disclaimer, the term of this patent is extended or adjusted under 35 U.S.C. 154(b) by 254 days.

(21) Appl. No.: 12/525,755

(22) PCT Filed: Feb. 4, 2008

(86) PCT No.: PCT/EP2008/051354

§ 371 (c)(1),
(2), (4) Date: Sep. 1, 2009

(87) PCT Pub. No.: WO2008/095902

PCT Pub. Date: Aug. 14, 2008

(65) Prior Publication Data

US 2010/0059611 A1 Mar. 11, 2010

(30) Foreign Application Priority Data

Feb. 7, 2007 (DE) ..... 10 2007 006 092

(51) Int. Cl.
*B02C 25/00* (2006.01)

(52) U.S. Cl. ..... 241/30; 241/36; 241/117

(58) Field of Classification Search ..... 241/36, 241/117–121

See application file for complete search history.

(56) References Cited

U.S. PATENT DOCUMENTS

| | | | | |
|---|---|---|---|---|
| 4,013,235 | A | 3/1977 | Halloran, Jr. | |
| 5,050,810 | A * | 9/1991 | Parham | 241/293 |
| 5,485,965 | A * | 1/1996 | Hostettler et al. | 241/29 |
| 7,063,282 | B2 * | 6/2006 | Jonkka et al. | 241/36 |
| 7,850,103 | B2 * | 12/2010 | Eriksson et al. | 241/30 |
| 7,926,754 | B2 * | 4/2011 | Hoffmann et al. | 241/117 |

FOREIGN PATENT DOCUMENTS

| | | | |
|---|---|---|---|
| DE | 7620223 | U1 | 12/1976 |
| DE | 19702854 | A1 | 7/1998 |
| DE | 102006050205 | * | 10/2006 |
| JP | 9212207 | A | 8/1997 |

* cited by examiner

*Primary Examiner* — Faye Francis
(74) *Attorney, Agent, or Firm* — Gifford, Krass, Sprinkle, Anderson & Citkowski, P.C.

(57) ABSTRACT

The invention relates to a method for comminuting material to be ground having a roller mill which has a mill platen, at least one mill roller and at least two drives for driving the roller mill, with there being provided a power compensation control system for the drives which controls the power of the drives at a predetermined ratio relative to each other by the speed of at least one drive being controlled.

11 Claims, 1 Drawing Sheet

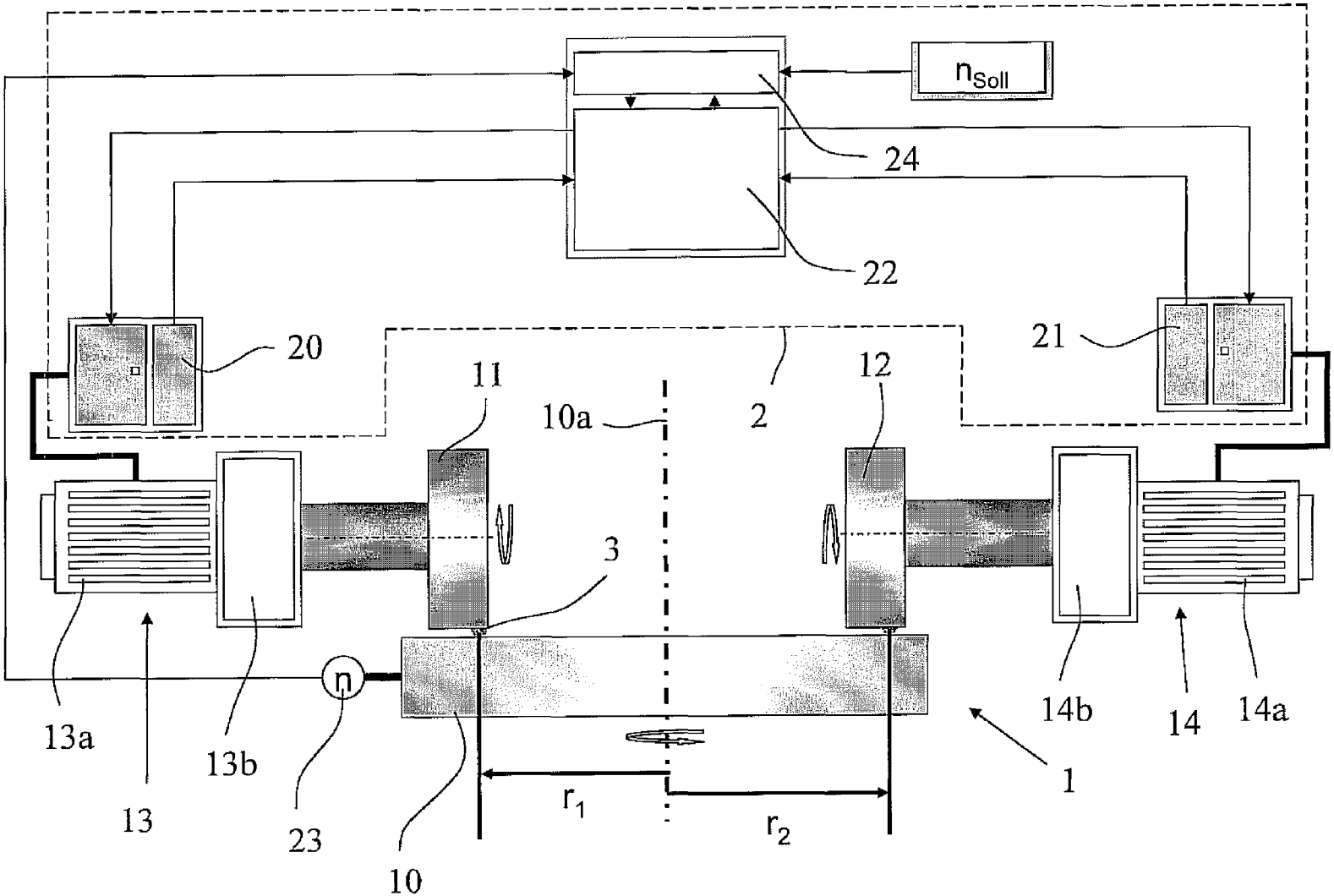
14a
14
14b
1
21
$n_{Soll}$
24
22
12
2
$r_2$
10a
3
$r_1$
11
10
23
20
13b
13
13a

METHOD FOR COMMINUTING MATERIAL TO BE GROUND USING A ROLLER MILL

CROSS REFERENCE TO RELATED APPLICATIONS

This application is the U.S. national phase of PCT/EP2008/051354 filed Feb. 4, 2008, which claims priority of German Patent Application 10 2007 006 092.2 filed Feb. 7, 2007.

FIELD OF THE INVENTION

The invention relates to a method for comminuting material to be ground having a roller mill which has a mill platen, at least one mill roller and at least two drives for driving the roller mill, with a compensation control operation being carried out for the drives.

BACKGROUND OF THE INVENTION

In practice, in roller mills the mill platen which drives the mill rollers over the mill bed is generally driven. However, this results in powerful fluctuations in power and consequently high loads on the drive mechanism so that there are great limitations on the drive power which can safely be transmitted.

Therefore, it has already been proposed in DE 197 02 854 A1 to drive the rollers. Reference was also made therein that the individual mill rollers, on the one hand, are connected together in terms of rotational driving by means of the mill platen and the comminution material or milling material bed located thereon but, on the other hand, can have widely differing power consumptions which are attributable, for example, to different rolling diameters on the mill platen (friction point/diameter), different operational diameters of the individual mill rollers (for example, owing to wear) and different behaviour involving the intake of the comminution material in conjunction with the mill platen and mill roller.

Even small changes in speed between individual mill rollers cause relatively high power fluctuations in the individual drives. This can result in the mill rollers constantly being accelerated or slowed down, that is to say, the individually driven mill rollers function counter to each other, which results in a significantly increased requirement for power or energy during comminution operation.

Therefore, it is proposed in DE-A1-197 02 854 that the operational fluctuations between the individual rotary drives of all the driven mill rollers be compensated for by a common load compensation control operation. However, the power consumptions of the drives are very different in the case of dynamic transmission changes between the mill platen and the mill roller.

Therefore, the problem addressed by the invention is to improve the compensation control operation for the drives.

SUMMARY OF THE INVENTION

The method according to the invention for comminuting material to be ground uses a roller mill which has a mill platen, at least one mill roller and at least two drives for driving the roller mill. A power compensation control operation is further carried out, with the power of the drives being controlled relative to each other at a predetermined ratio by the speed of at least one drive being controlled.

In that manner, it is possible for dynamic transmission changes between the mill platen and the mill roller to be compensated for reliably, with different speeds being admissible for the drives in a quite deliberate manner.

According to a preferred embodiment, at least two mill rollers are driven by means of an associated drive, respectively. The mill platen is driven only by means of the at least two mill rollers and the material to be ground. However, it is also conceivable for an independent drive to be associated with the mill platen.

The speed of the drives is controlled by means of frequency converters which preferably function with field-orientated control.

According to a preferred embodiment, the power compensation control system further comprises control of the speed of the mill platen, with a predetermined speed of the mill platen preferably being maintained.

Other advantages and constructions of the invention will be explained in greater detail below with reference to the description and the drawing.

BRIEF DESCRIPTION OF THE DRAWING

The drawing is a schematic illustration of a roller mill having power compensation control.

DETAILED DESCRIPTION OF THE INVENTION

The drawing schematically illustrates a roller mill 1 which has a mill platen 10, at least two mill rollers 11, 12 and at least two drives 13, 14 for driving the two mill rollers 11, 12. Each drive comprises a motor 13*a*, 14*a* and gearing 13*b*, 14*b*. According to the invention, of course, it is also possible for a plurality of mill rollers, in particular three, four or more mill rollers, to be provided.

The mill platen 10 can be freely rotated about an axis of rotation 10*a* so that it is rotated only by means of the driven mill rollers 11, 12 and the material 3 to be ground between the mill roller and the mill platen. However, it would also be possible for an independent drive to be associated with the mill platen.

The transmission of the rotary movement of the mill rollers 11, 12 to the mill platen 10 is brought about via the material 3 to be ground. The transmission ratio of the mill roller to the mill platen changes continuously owing to the grinding material bed which in practice is formed in a relatively non-uniform manner. The transmission ratio is ultimately determined by the distance of the force application point between the mill roller axis and the mill platen axis. In the drawing, the distance $r_1$ of the force application point of the mill roller 11 relative to the axis of rotation 10*a* is smaller than the distance $r_2$ of the friction point of the mill roller 12 relative to the axis of rotation 10*a*.

However, a different transmission ratio results in different torques being transmitted to the mill platen with the same speed of the mill rollers 11, 12. One drive is thereby braked or accelerated relative to the other drive. The resultant powerful fluctuations in power of the drives result in an increased energy requirement. The desired power distribution between the drives is further destroyed as a result.

In order to prevent those effects, a power compensation control system 2 is provided, with the power of the drives 13, 14 being controlled at a predetermined ratio relative to each other by the speed of at least one drive being controlled. In the embodiment illustrated, identical drives 13, 14 are provided for the two identically constructed mill rollers 11, 12 so that the power compensation control system keeps the power of the two drives at the same level.

However, it would also be conceivable for the mill platen to have its own drive, in addition to one or more mill rollers. In that case, the mill platen could be driven with lower or higher power than the mill rollers.

The power compensation control system 2 substantially comprises, in the embodiment illustrated, a frequency converter 20, 21 which is associated with the drives 13, 14, a power compensation control unit 22, a mill platen speed sensor 23 and a mill platen speed control unit 24.

The frequency converters 20, 21 are provided with a field-orientated control system in a manner known per se. They receive from the drives 13, 14 the instantaneous motor current or the motor voltage. The power consumption of each drive is established therefrom, and a variable cumulative mean value is formed and is weighted with a factor (with identical power levels of the drives equal to 0.5) and constitutes the desired value of the drive. This value is substantially dependent only on the speed of the respective drive when the resistance moment is practically constant.

A deviation between the actual power and the desired power of the drives is supplied to the power compensation control unit 22 which brings about power adaptation of the two drives 13, 14 by the speed of one or both drives being adapted in such a manner that the power of the two drives is controlled at the predetermined ratio, in the present case at the same level. It is further taken into consideration that the mill platen 10 rotates at a predetermined desired speed $n_{soll}$.

Advantageously, however, there is provided an additional control system for the mill platen speed, which is implemented in this instance by the mill platen speed control unit 24. The mill platen speed control unit 24 is connected to the mill platen speed sensor 23 and continuously receives the actual value of the speed of the mill platen which is compared with the desired value $n_{soll}$, which results in the system deviation. The control unit produces therefrom the desired speed of the drives 13, 14 with a transmission ratio which is assumed to be fixed.

The frequency converters 20, 21 have an internal speed control unit and a jointly operating motor model, whereby the drive speed of the drives and the motor torque can be derived. Advantageously, the frequency converters must be capable of inputting or outputting control and status data every 5 ms at least so that the function of the power compensation control system is ensured.

In technical control terms, the system is in the form of a cascade control, with the individual levels being dynamically decoupled from each other and consequently being able to be considered individually. The advantage of the above-described control is that the power consumption levels of the drives 13, 14 deviate from each other only slightly with a power compensation control unit and even powerful changes in the system (transmission transfer) become very rapid.

It is further advantageous that it is possible to dispense practically completely with complex and maintenance-intensive measurement techniques because the frequency converters used provide all the relevant data except for the mill platen speed. Control interventions can further be carried out in a practically power-free manner with the frequency converters so that the overall degree of efficiency is equivalent to a controlled drive.

The invention claimed is:

1. A method for comminuting material to be ground, the method comprising providing a roller mill (1) which has a mill platen (10), at least one mill roller (11, 12) and at least two drives (13, 14) for driving the roller mill (1), providing a compensation control system formed by a power compensation control system (2), carrying out a compensation control operation for the at least two drives with the power of the at least two drives being controlled at a predetermined ratio relative to each other by controlling the speed of at least one of the at least two drives (13, 14).

2. The method according to claim 1, characterised in that a drive (13, 14) is associated with each of the at least two mill rollers(11, 12).

3. The method according to claim 2, characterised in that the mill platen (10) is driven only by means of the at least two mill rollers (11, 12) and the material (3) to be ground.

4. The method according to claim 1, characterised in that the power compensation control system (2) further comprises controlling of the speed of the mill platen (10).

5. The method according to claim 1, characterised in that the speed of the drives (13, 14) is controlled in such a manner that a predetermined speed of the mill platen (10) is further maintained.

6. The method according to claim 1, characterised in that the power compensation control system (2) comprises a motor model.

7. The method according to claim 1, characterised in that the control of the speed of the drives (13, 14) is carried out by means of frequency converters (20, 21).

8. The method according to claim 1, characterised in that the power consumption of the drives (13, 14) is detected.

9. The method according to claim 1, characterised in that an independent drive is associated with the mill platen (10).

10. A roller mill (1) having a mill platen (10), at least one mill roller (11, 12), at least two drives (13, 14) for driving the roller mill (1) and a compensation control system for the drives, characterised in that the compensation control system is formed by a power compensation control system (2) operable to control the at least two drives at a predetermined ratio relative to each other by controlling the speed of at least one of the at least two drives.

11. The roller mill according to claim 10, characterised in that the power compensation control system (2) comprises a frequency converter (20, 21) associated with the drives (13, 14), a power compensation control unit (22), a mill platen speed sensor (23) and a mill platen speed control unit (24).

* * * * *